US007798786B2

(12) United States Patent
Robinson

(10) Patent No.: US 7,798,786 B2
(45) Date of Patent: Sep. 21, 2010

(54) PUMP

(76) Inventor: Philip Edward Robinson, West Oak Lodge, The Barn, Woolton Hill, Newbury, Berkshire (GB) RG20 9UX ( * ) Notice: Subject to any disclaimer, the term of this patent is extended or adjusted under 35 U.S.C. 154(b) by 901 days.

(21) Appl. No.: 10/599,038

(22) PCT Filed: Mar. 19, 2004

(86) PCT No.: PCT/GB2004/001172

§ 371 (c)(1),
(2), (4) Date: Jan. 22, 2007

(87) PCT Pub. No.: WO2005/090787

PCT Pub. Date: Sep. 29, 2005

(65) Prior Publication Data

US 2007/0258839 A1 Nov. 8, 2007

(51) Int. Cl.
*F04B 35/06* (2006.01)
*F04B 33/00* (2006.01)

(52) U.S. Cl. ..... 417/231; 417/234; 417/236; 417/313; 152/416; 280/201

(58) Field of Classification Search ..... 417/313, 417/234, 231, 236, 468, 469, 521; 280/201; 152/415, 416
See application file for complete search history.

(56) References Cited

U.S. PATENT DOCUMENTS 1,163,429 A * 12/1915 Magim ..... 280/288.4
4,712,592 A * 12/1987 Brown ..... 141/98
4,842,290 A 6/1989 Alioto ..... 280/201
5,137,430 A 8/1992 Alioto ..... 417/231
5,324,174 A * 6/1994 Diotte ..... 417/234
5,347,913 A 9/1994 Stephner ..... 92/58.1
5,499,858 A * 3/1996 Her ..... 297/195.1
6,017,201 A * 1/2000 Yang ..... 417/454
6,120,258 A * 9/2000 Chen ..... 417/231
6,953,326 B2 * 10/2005 Wang ..... 417/234
2003/0156950 A1 * 8/2003 Ostrowiecki ..... 417/234

FOREIGN PATENT DOCUMENTS

DE 20212893 6/2003
JP 5-500400 8/1989
WO WO9102159 2/1991

OTHER PUBLICATIONS

Related Japanese Office Action With English Translation for Application No. 2007-503391; Dated Sep. 7, 2009; 4 Pages.

* cited by examiner

*Primary Examiner*—Devon C Kramer
*Assistant Examiner*—Leonard J Weinstein
(74) *Attorney, Agent, or Firm*—Koppel, Patrick, Heybl & Dawson

(57) ABSTRACT

A manually operated pump for a bicycle comprises two cylindrical members with a first cylindrical member slidable within a second cylindrical member. One end of the first cylindrical member is provided with a fitting to receive a saddle while one end of said second cylindrical member is provided with a foot stand assembly which comprises a foldable foot stand and a retractable air hose. The pump is designed to be received in the seat post of the bicycle frame and the two cylindrical members are arranged to be releasably connected together in a closed position.

4 Claims, 3 Drawing Sheets

PUMP

BACKGROUND OF THE INVENTION

1. Field of the Invention

This invention relates to a device for supplying air to a tyre of a cycle. More particularly, but not exclusively, this invention relates to a pump used to supply air to a tyre of a cycle, eg a bicycle.

2. Description of the Related Art

The popularity of cycling has increased significantly in recent years. In 1999, world production of bicycles exceed that of the motor car by three times, and with technological advances in the design of the bicycle together with changing social and environmental attitudes, people of all ages are increasingly cycling as part of a personal or social agenda.

The performance and maintenance of the cycling equipment is important to most people within the cycling community. The maintenance is usually performed using cycling accessories which are well known in the art.

One such essential accessory required by a cyclist is a pump. There are many different types of pumps available but each has its advantages and drawbacks.

The single chamber pump is a large stroke pump which is usually detachably connected to the frame of a cycle. One major drawback is its exposure to potential thieves due to its large size so this kind of pump is not considered very secure.

Another pump introduced to overcome this drawback is the "mini" air pump. This pump is usually smaller stroke than the conventional single chamber pump so allows the user readily to detach the pump from the cycle and enable the pump to be carried with the user. This feature handles the problem of exposing the pump to potential thieves. However, the small size of the pump reduces the amount of air being delivered by the pump due to the shorter pumping strokes and smaller air barrel.

A pump used by many cycling enthusiasts is the floor standing pump and this pump offers a solution to the limited pressure available from the mini-pump by providing a pump which can handle increased pressures due to a longer swept volume. However, such pumps are not portable with the cycle due to their size and weight and are usually expensive.

SUMMARY OF THE INVENTION

An object of the present invention is to provide a truly portable pump that can overcome the limitations of the prior art to arrive at a pump which is discreet, when a cycle is left unattended, and efficient by providing high volumes of air on each stroke of the pumping action.

From one aspect, the present invention provides a manually operated pump comprising:

Two cylindrical members with a first cylindrical member slidable within a second cylindrical member, wherein one end of the first cylindrical member is provided with a fitting to receive a saddle;

said second cylindrical member is provided with an outlet for connection with an attachable adapter, the arrangement being such that said one end of the first cylindrical member is graspable by a user in order to reciprocate the cylindrical members with respect to each other.

From another aspect, the present invention is incorporated into a frame of a cycle, the frame having a tubular section receiving a post mounting a saddle characterised in that the post forms a manually operated pump.

In use, the seat post which forms a manually operated pump is removed from the tubular section of said frame and a foot stand is unfolded at one end of the post to allow an operator's foot to be placed onto it, to secure the second cylinder on the ground during an inflation process. The saddle on the other end of the post is used as a handle for the pump during the inflation process. The end of the post with the foot stand is further provided with a retractable air hose which is stored within the pump and extends away from the post when required and is retractable back into its storage position in the post when the hose is no longer required.

BRIEF DESCRIPTION OF THE DRAWINGS

In order that the present invention be more readily understood, embodiments thereof will now be described by way of example with reference to the accompanying drawings, in which:—

DETAILED DESCRIPTION OF THE INVENTION

The preferred embodiment of the present invention is a pump which is of such a construction that it can also serve the purpose of being the seat post of a cycle. This requires the external diameter of the pump body to be capable of being received within the bore of the part of the cycle frame which normally receives the seat post.

Figure 1:
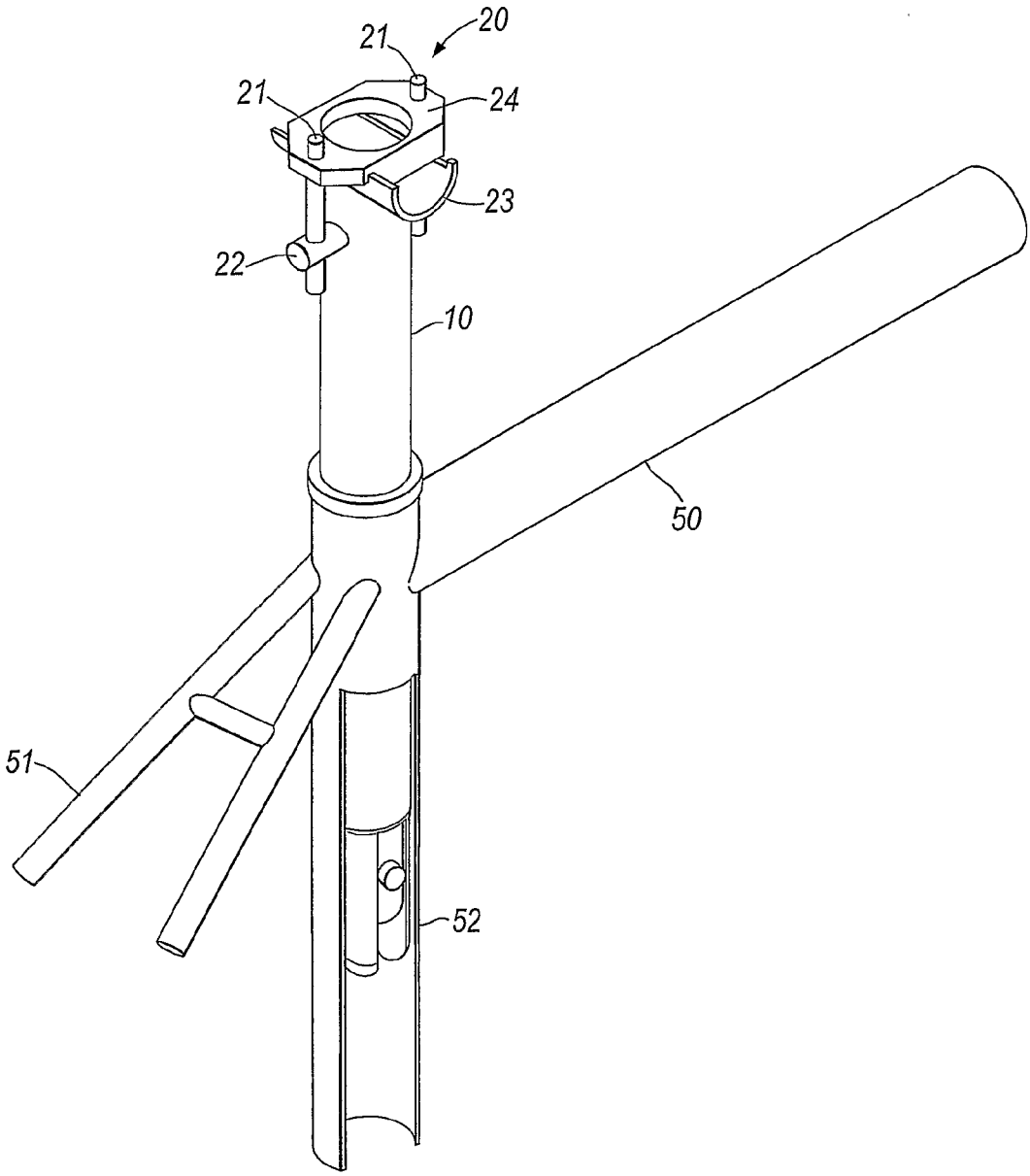
FIG. 1 shows a diagrammatic perspective view of a pump in a cycle frame.

FIG. 1 shows a part of the frame of a cycle with a seat post/pump in position in the frame. The frame is represented by Tear wheel forks 51, a cross bar 50 and a rear frame member 52. The rear frame member 52 is constructed in such a way as to be capable of receiving a seat post 10 in the normal fashion so that the seat post 10 can be adjustable and releasable in a conventional manner so that the height of the seat with respect to the ground can be altered.

One end of the seat post 10 is provided with a fitting arrangement 20 which is adapted to receive a saddle (not shown). The exact manner in which the saddle is attached to the seat post is not significant and can be altered to permit any desired type of saddle to be fitted to the seat post. In the present embodiment this is shown to comprise a clamping mechanism 20 constituted by a member 22 to be received by an opening in the seat post 10. Two further members 21 extend from the member 22 in a direction parallel to the axis of the post 10 and together with a further member 24 form a clamping arrangement to clamp a portion of a saddle to a shaped recess 23 fixed to the end of the post 10.

In the present embodiment, the post 10 also forms a pump for inflating the tyres of the cycle. Such a pump is shown in more detail in FIG. 2.

Figure 2:
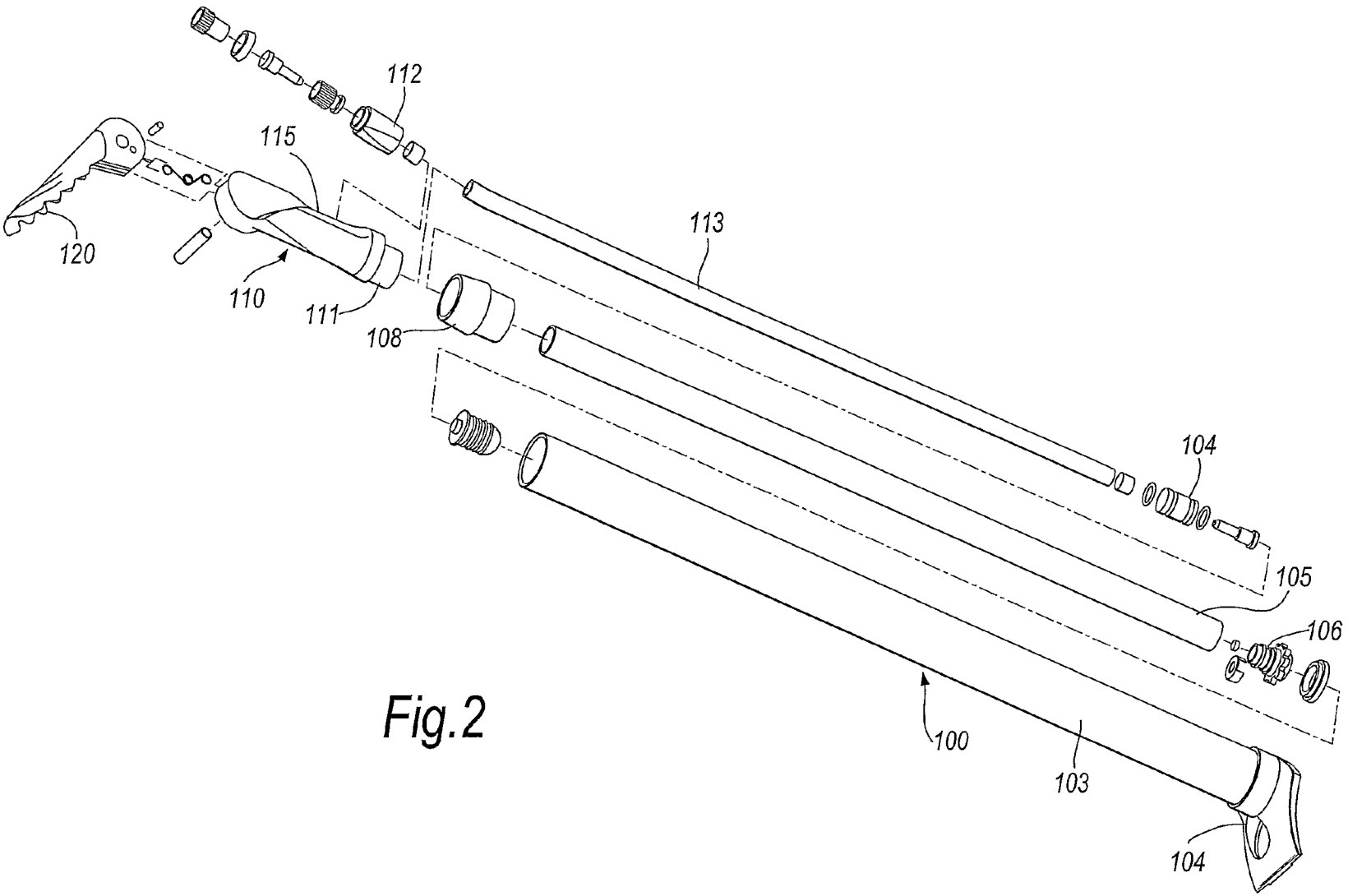
FIG. 2 is an exploded perspective view showing the construction of a seat post pump according to the present invention.

In FIG. 2, the seat post 10 is actually formed by an outer tubular member 103 which is shown to be a cylinder of a diameter which will be a sliding fit in the rear frame member 52 of the cycle frame. In FIG. 2, the fitting for attaching the saddle to the seat post is represented by a member 104. The cylinder 103 is closed at this end. The other end of the cylinder 103 is open in order to receive a piston assembly constituted by a her cylinder 105, one end of which is provided with a piston member 106 which incorporates a non-return valve as well as a flexible piston ring as is usual in a cycle pump. Relative sliding motion between the further cylinder 105 and the outer cylinder 103 compresses air in the cylinder 103 which is then forced through the piston member 106 into the interior of the cylinder 105. The cylinder 105 is retained within the cylinder 103 by means of a collar 108 which will be described in more detail later and which is fixed to the end of the cylinder 103.

The cylinder 105 is a rigid metal tube with the piston member 106 at one end. The other end is provided with a foot-stand assembly 110 which is fixed to the end of the cylinder 105 in any convenient fashion such as by a main assembly body 111 being a screw fit into the end of the cylinder 105.

The main assembly body 111 is provided with a foldable foot stand 120 and a recess 115 for receiving a connector 112 for connecting the pump to a tyre valve. The connector 112 is provided on one end of a flexible tube 113, the other end of which is provided with a sealing member 114 so as to form a sliding seal for the tube 113 in the bore of the cylinder 105. This permits the connector 112 and part of the tube 113 to be drawn out of the pump for use and slid back into the pump for storage with the connector 112 housed in the recess 115 in the main assembly body 111.

It is to be noted that with the foot stand folded and the connector 112 in the recess 115, the external dimensions of the main assembly body are such as to enable the assembled pump to be received in the bore of the rear frame member 52 of the cycle frame.

Figure 3:
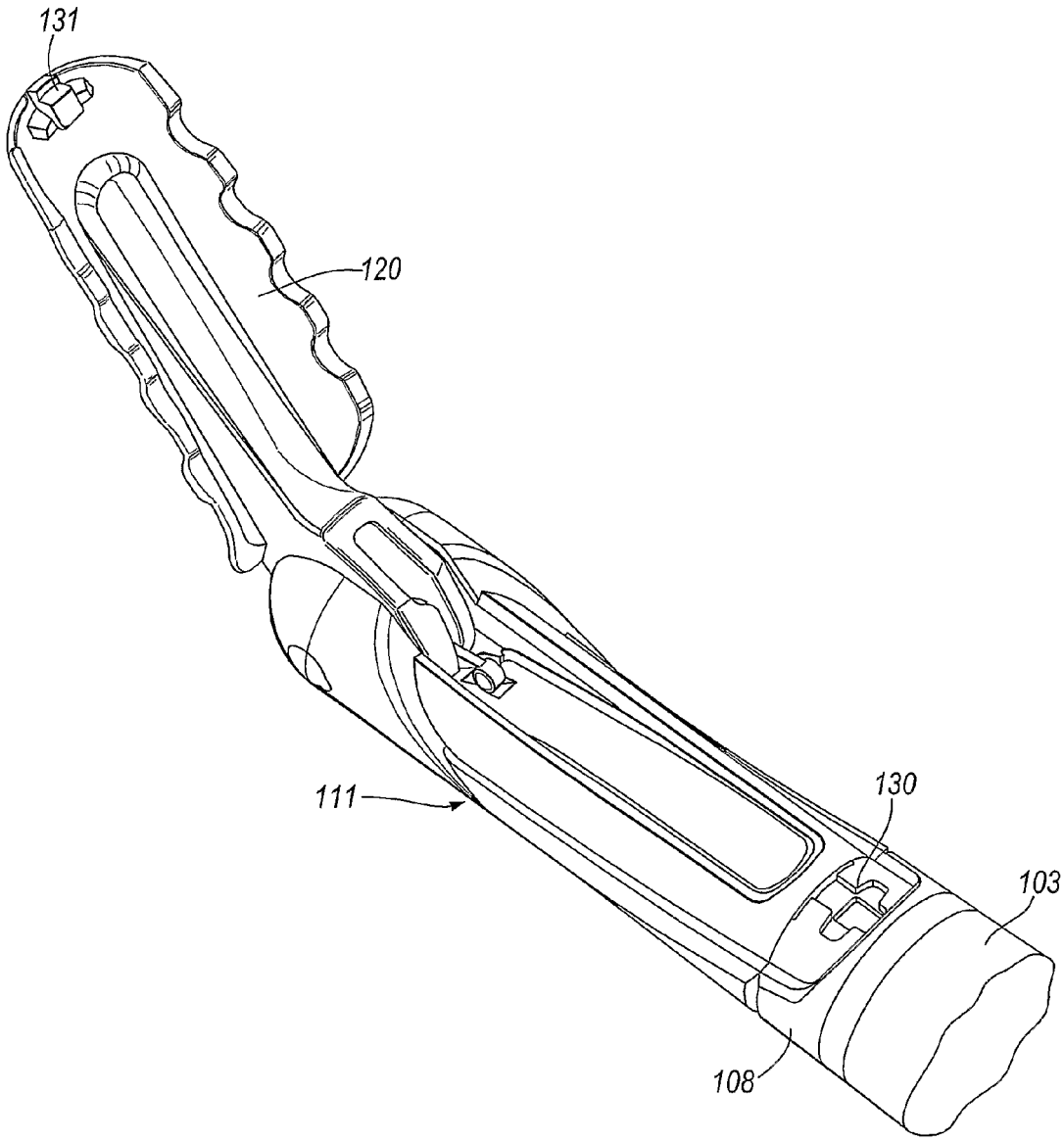
FIG. 3 is a perspective view to an enlarged scale of one end of the seat post pump shown in FIG. 2.

Turning now to FIG. 3, this shows in more detail the construction of the main assembly body 111 as well as the collar 108. In particular, it shows the relationship between the main assembly body 111 provided on the end of the further cylinder 105 and the collar 108 fixed to the end of the outer cylinder 103. From FIG. 3, it will be noted that the collar 108 is provided with means for latching together the cylinders 103 and 105 when not in use. This is achieved by the collar 108 having means for retaining the main assembly body 111. In this embodiment, this is shown to be by means of the collar 108 being made of a resilient plastics material and being formed with a retaining slot 130 which is arranged to receive a projection 131. In this embodiment, the projection 131 is formed on the foot stand 120 so as to ensure that the foot stand and the further cylinder 105 are both latched to the outer cylinder 103 when not in use.

It will be appreciated that other latching arrangements can be utilised. For example, the main assembly body 111 might itself be directly formed with a projection which could be received in the recess 130 in which case the foot stand would simply be folded closed.

In any event, the arrangement is such that the pump is held in a closed condition stably within the frame of the cycle which prevents unnecessary rattling of the pump within the frame.

It will also be noted that the foot stand 120 is curved so that it conforms to the overall outer diameter of the tubular member 103.

Although not shown, it is possible to make the connector 112 a snap fit in the recess 115 and additionally or alternatively provide it with a resilient finger which may extend slightly outwardly of the overall cross sectional profile of the pump so as to engage with the internal bore of the rear frame member 52 so as to again prevent rattling when the seat post pump is in situ within the frame.

The invention claimed is:

1. A manually operated pump comprising:

two cylindrical members, comprising a first cylindrical member and a second cylindrical member, slidable in relation to each other such that one cylindrical member can slide within the other cylindrical member;

wherein one end of the first cylindrical member is provided with a fitting to receive a saddle, and said second cylindrical member is provided with a foot stand assembly which comprises a foldable foot stand and a retractable air hose;

wherein the foldable foot stand can be unfolded for use and can be folded away when no longer required;

wherein the retractable air hose is retractable back into a storage position within the pump;

wherein the two cylindrical members are latched together in a releasable manner and wherein the latching is achieved by means of an inter-engaging projection and a recess on the foldable foot stand and the first cylindrical member.

2. The manually operated pump according to claim 1, wherein said pump is provided with a manually graspable member for operating the pump.

3. The manually operated pump according to claim 2, wherein the manually graspable member is the saddle.

4. A cycle comprising a tubular section receiving a seat post, the post being the pump according to claim 1.

* * * * *